US007137875B2

(12) United States Patent
Jeansson

(10) Patent No.: US 7,137,875 B2
(45) Date of Patent: Nov. 21, 2006

(54) GRINDING HEAD FOR A MOBILE GRINDING MACHINE AND MOBILE GRINDING MACHINE COMPRISING SUCH A GRINDING HEAD

(75) Inventor: Sten Jeansson, Linghem (SE)

(73) Assignee: HTC Sweden AB, Soderkoping (SE)

( * ) Notice: Subject to any disclaimer, the term of this patent is extended or adjusted under 35 U.S.C. 154(b) by 0 days.

(21) Appl. No.: 11/298,392

(22) Filed: Dec. 8, 2005

(65) Prior Publication Data

US 2006/0172667 A1 Aug. 3, 2006

Related U.S. Application Data

(60) Provisional application No. 60/634,544, filed on Dec. 10, 2004.

(30) Foreign Application Priority Data

Dec. 10, 2004 (SE) ..... 0403011-0

(51) Int. Cl.
*B24B 23/02* (2006.01)

(52) U.S. Cl. ..... 451/350; 451/342

(58) Field of Classification Search ..... 451/350, 451/353, 41, 119, 120, 342; 125/38, 5, 2, 125/25

See application file for complete search history.

(56) References Cited

U.S. PATENT DOCUMENTS 1,928,390 A 9/1933 Myers
2,200,921 A * 5/1940 Granell ..... 451/353
2,316,886 A * 4/1943 Eugenio ..... 451/353
2,716,312 A * 8/1955 Speicher ..... 451/342
6,231,432 B1 * 5/2001 Peterson et al. ..... 451/350
6,263,605 B1 * 7/2001 Vanell ..... 451/443

FOREIGN PATENT DOCUMENTS

GB 2 235 367 A 3/1991
WO 94/08752 4/1994

* cited by examiner

*Primary Examiner*—Robert A. Rose
(74) *Attorney, Agent, or Firm*—Merchant & Gould P.C.

(57) ABSTRACT

The invention concerns a grinding head for a mobile grinding machine which is suitable for grinding floor surfaces, and a mobile grinding machine comprising such a grinding head. The grinding machine is driven by a motor and has a rotatable planet disc and grinding heads (5–7) rotatable relative to this. The grinding heads (5–7) comprise a carrier (8) which is designed to be rotated by means of the motor, and a grinding disc (9) designed to be driven by the carrier (8) by means of a coupling element (10). The coupling element (10) comprises a multiplicity of plates (11–13) which are stacked on each other, each with a central opening (14) and drain holes (15) distributed around this, and a compression spring (16) which extends through the central opening (14) of the plates (11–13) and by means of screw elements (17) is clamped between the carrier (8) and the grinding disc (9). The screw elements (17) extend through the drain holes (15) of the plates (11–13) and are arranged to connect, alternately in a circular direction around the central opening (14) of the plates (11–13), the carrier (8) with the plate (13) nearest the grinding disc (9) and the grinding disc (9) with the plate (11) nearest the carrier (8). A coupling element is also shown for a mobile grinding machine for grinding a stone floor.

12 Claims, 3 Drawing Sheets

GRINDING HEAD FOR A MOBILE GRINDING MACHINE AND MOBILE GRINDING MACHINE COMPRISING SUCH A GRINDING HEAD

TECHNICAL FIELD

The present invention concerns a grinding head for a mobile grinding machine for grinding stone floors, which machine comprises a body supporting a drive motor, a planet disc mounted on the body and a multiplicity of grinding heads mounted on the planet disc, where the planet wheel is rotatable by means of the motor about a central, substantially vertical rotation axis and the grinding heads in relation to the planet wheel are rotatable about substantially vertical planet axes which are distributed around said rotation axis.

PRIOR ART

W094/08752 discloses a grinding machine which is intended for precise flat grinding of stone floors, in particular those made of concrete. The grinding machine comprises a multiplicity of grinding heads which each comprise a carrier designed to be rotated by the motor, and each a grinding disc designed to be driven by the carrier by means of a coupling element established between the carrier and the grinding disc. In the known grinding machine, the coupling element between the carrier and the grinding disc normally comprises a fibre-reinforced pad which has opposing sides connected with the carrier and grinding disc respectively. The pad allows, in the thickness direction of the pad, the transfer of axial pressure via the pad against the floor support and in the width direction of the pad, a transfer of rotation forces via the fibre reinforcement. The cloth however has the limitation that in its thickness direction it can only absorb minimum angular deviations. Even if absolute flatness is not required on the abraded floor, this disadvantage means that the grinding must largely continue until absolute flatness has been achieved as it is not otherwise ensured that the entire floor surface has been abraded.

An evident solution to the problem can apparently be provided by a thicker pad or several pad layers. This does not however work in practice because of the greater torque which the coupling element must transfer. For the same reason coupling elements comprising elastomer bushes have been found to be unsuitable.

In this context, the object of the invention is to achieve a grinding head according to the introduction which allows the transfer of high torque and absorbs large angular deviations.

BRIEF SUMMARY OF THE INVENTION

This object is achieved according to the invention in that the grinding head concerned comprises a carrier that is designed to be rotated by means of a motor, and a grinding disc that is designed to be driven by the carrier by means of a coupling element established between the carrier and the grinding disc, which coupling element comprises a multiplicity of plates which are stacked upon each other, each with its central opening and at least four drain holes distributed around this, and a pressure spring which extends through the central opening of the plates and by means of screw elements is tensioned between the carrier and the grinding disc, which screw elements extend through the drain holes of the plates and are arranged to connect, alternately in a circular direction around the central opening of the plates, the carrier with the plate nearest the grinding disc and the grinding disc with the plate nearest to the carrier.

By producing a grinding head with a coupling element in which a plate material is used instead of a fibre reinforced pad or elastomer bush, it will be easily be possible to transfer very high torque. By applying the solution of plates, it is also possible to compensate for relatively large angular deviations in the abraded floor support. By also fitting a compression spring, the necessary compression forces can also be transferred.

According to a preferred embodiment the coupling element at the drain holes of the plates has spacer elements at least between the plates, which spacer elements are suitably annular metal washers which have a rounded outer edge. The advantage of the spacer element is that by reducing the contact surfaces between the plates, the wear between these is also reduced and hence the flexibility of the coupling element increased. The advantage with the special metal washers is that they eliminate any buckling points for the plates which could otherwise over time lead to material fatigue.

The compression spring is advantageously a substantially circular cylindrical block of elastomer material as such a solution is both cheap and durable. Alternatively the compression spring can also be made of metal such as a coil spring or spring washer.

The plates are suitably annular and have projecting lugs in which are formed the drain holes, whereby the contour between said lugs advantageously has the form of an inward curve towards the central opening of the plate. It will be seen that the annular plates with a narrower part between the drain holes give good flexibility for the coupling element at the same time as the projecting lugs give good strength around the drain holes, both these properties being best achieved using the said contour in the form of an inward curve. It is also seen that for strength reasons it is suitable always to leave intact plate material in a straight line between two adjacent drain holes.

Advantageously the carrier is formed as a circular plate in which are formed alternately screw holes for connection with the screw elements connected with the plate nearest the grinding disc, and recesses for clearance of the screw elements connected with the plate nearest the holder. By also selecting a disc-shaped solution for the carrier, a very flat and robust coupling element is achieved which is ideal for mounting in existing grinding machines for example of the type described in W094/08752.

In the grinding disc are advantageously provided alternately screw holes for connection with the screw elements connected with the plate nearest the carrier, and recesses for clearance of the screw elements connected with the plate nearest the grinding disc. This solution too also helps make the coupling element flat and compact, which can further be accentuated by countersinking the screw holes. It will be seen that countersunk screw holes must be adapted to the screw heads present and that for example a cylindrical screw head requires countersinking in the form of a stepped bore.

Preferably for the arrangement according to the invention screw elements are used which comprise a screw head, a circular cylindrical part connected thereto which has a length adapted to the height of the stack of plates, a threaded part which has a smaller diameter than the circular cylindrical part and a nut which can be screwed onto the threaded part. Screw elements formed in this way ensure in a simple manner that after mounting, the plate elements used are clamped with the correct force.

According to a further aspect of the invention this comprises a coupling element for a mobile grinding machine for grinding a stone floor, for transferring a torque from a carrier to a grinding disc.

BRIEF DESCRIPTION OF THE DRAWINGS

A preferred embodiment of the grinding head according to the invention is described in more detail below in connection with a mobile grinding machine and with reference to the enclosed diagrammatic drawings which show.

DESCRIPTION OF A PREFERRED EMBODIMENT

Figure 1:
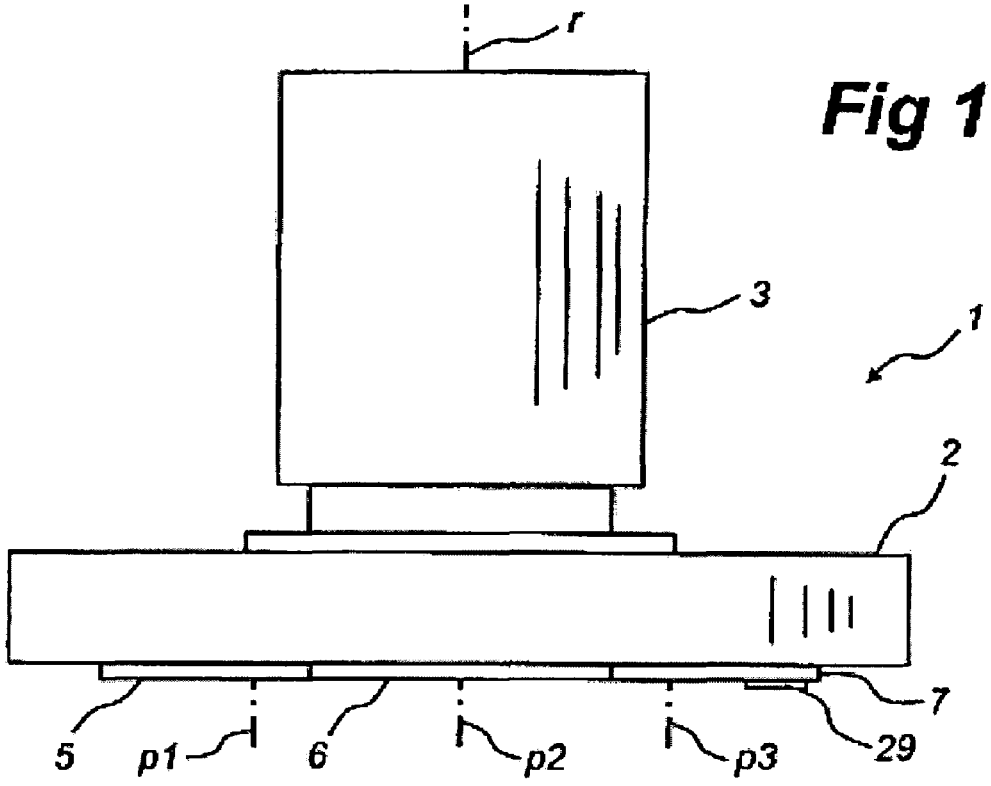
FIG. 1 in a side view a mobile grinding machine with three grinding heads.

On the drawings the same reference numerals are used throughout the various figures to indicate the same parts. For the sake of clarity however not all reference numerals are repeated in all figures and for a complete description of the embodiment shown, all figures should be considered.

Figure 2:
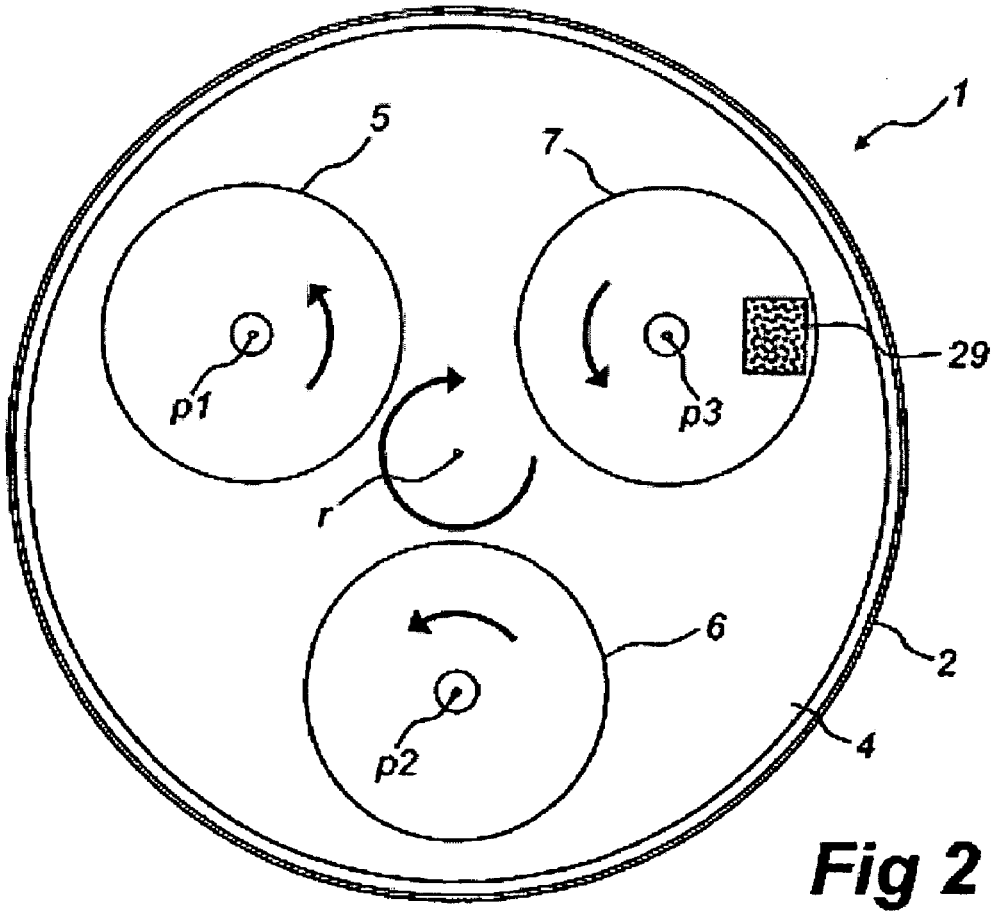
FIG. 2 a view of the grinding machine from below.
Figure 3:
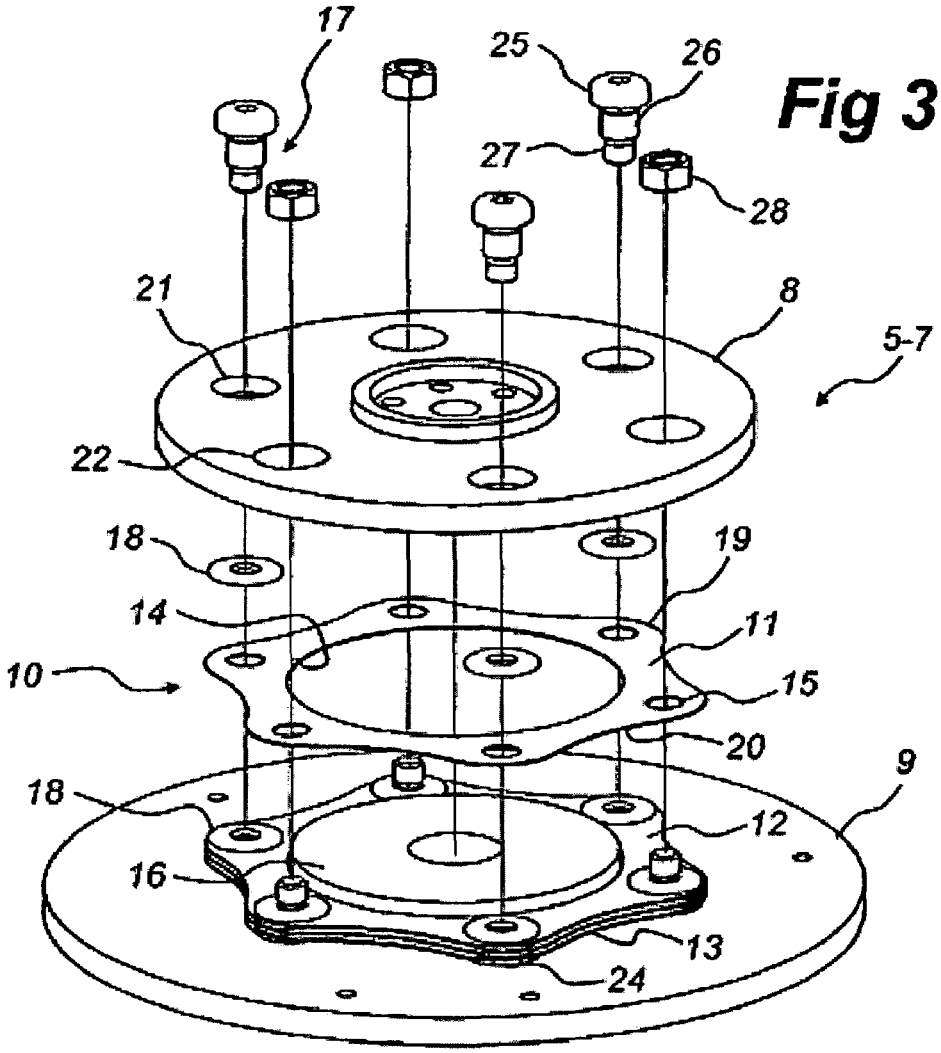
FIG. 3 an exploded view of a grinding head.
Figure 4:
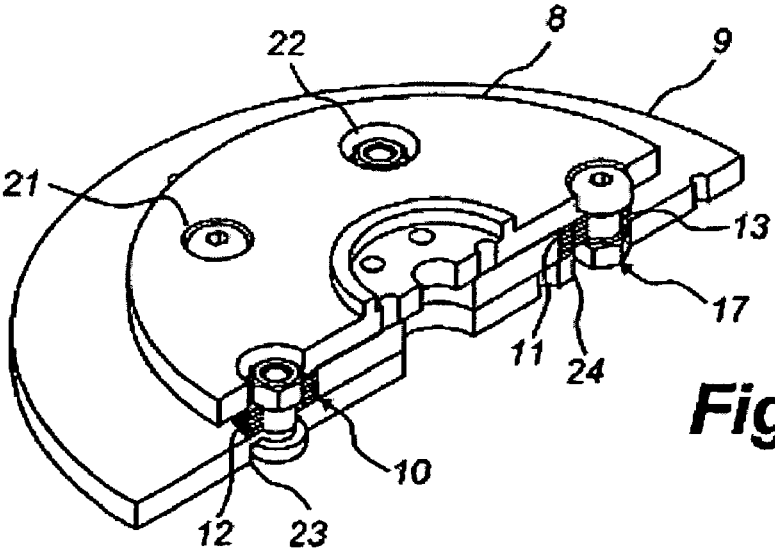
FIG. 4 a sectioned perspective view of the grinding head.
Figure 5:
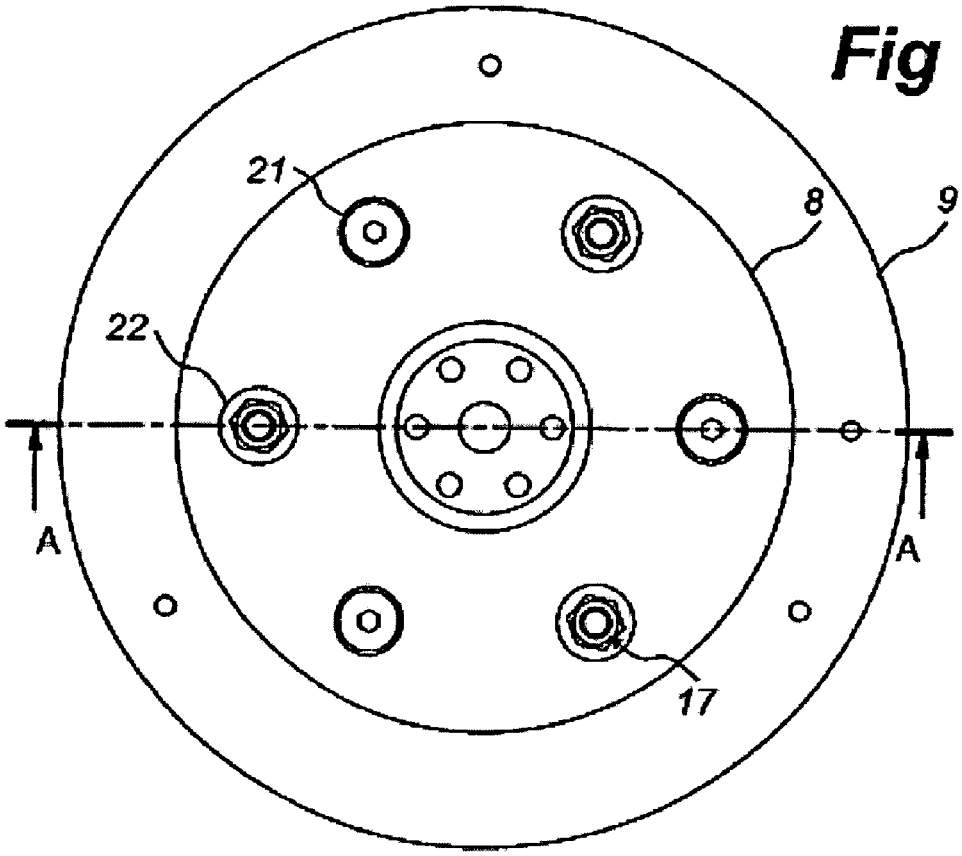
FIG. 5 a plan view from above of the grinding head.
Figure 6:
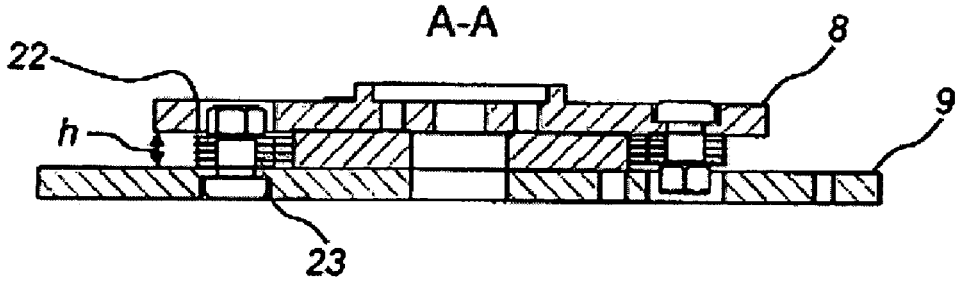
FIG. 6 a cross-section view through the grinding head.

The preferred embodiment of the grinding head according to the invention is intended for a mobile grinding machine 1 for grinding a stone floor, where this does not exclusively concern a concrete floor. The grinding machine 1 comprises a body 2 to which is coupled a handle arrangement not shown and which carries a drive motor 3, a circular planet disc 4 mounted in the body 2, and three grinding heads 5–7 that are mounted on the planet disc 4 and have an underside intended for mounting of a grinding tool not shown. The planet disc 4 is rotatable by means of the motor 2 in FIG. 2 clockwise around a central, substantially vertical rotation axis r, and the grinding heads 5–7 are rotatable relative to the planet disc 4 in FIG. 2 counter-clockwise about substantially vertical planet axes p1–p3 which are evenly distributed around the said rotation axis r.

Each grinding head 5–7 comprises a carrier 8 which is designed to rotate by means of the motor 2 and a grinding disc 9 which is arranged to be driven by the carrier 8 by means of a coupling element 10 established between the carrier 8 and the grinding disc 9. The coupling element 10 comprises four plates 11–13 which are stacked on each other and each have their central opening 14 and six drain holes 15 evenly distributed around this, and a compression spring 16 in the form of a circular cylindrical block of elastomer material which extends through the central opening 14 of the plates 11–13 and by means of the screw elements 17 is tensioned between the carrier 8 and the grinding disc 9. Thus the screw elements 17 extend through the drain holes 15 of the plates 11–13 and are arranged to connect alternately, in a circular direction around the central opening 14 of the plates 11–13, the carrier 8 with the plate 13 nearest the grinding disc 9 and the grinding disc 9 with the plate 13 nearest the carrier 8.

In the preferred embodiment of the arrangement according to the invention, the coupling element 10, at the drain holes 15 of the plates 11–13, has spacer elements 18 at connecting points between the carrier 8 and the plate 11 closest to this, between the plates 11–13 as such and at the connecting points between the grinding disc 9 and the plate 13 closest to this. The spacer elements 18 are constituted in particular by annular metal washers which have rounded outer edges so that no buckling of the plates 11–13 can occur around the spacer elements 18 when the plates 11–13 are mutually sprung.

The plates 11–13 as such are totally identical and in the preferred embodiment are four in number. This number is not however compulsory but is selected according to the material quality of the plates 11–13, for example spring steel, and the material thickness e.g. 0.5 mm, and where applicable also with regard to their diameter and the forces to be transmitted. According to the preferred embodiment the plates 11–13 are annular and have a polygonal base shape with projecting lugs 19 located in the corners of the polygon and in which are formed drain holes 15, and between the lugs 19 a contour in the form of a curve 20 curving in towards the central opening 14 of the plates 11–13. As a result great strength is achieved due to the amount of material at the drain holes 15, and maximum flexibility between these where the curve 20 draws closest to the central opening 14.

The carrier 8 is as shown structured as a circular plate in which are formed alternately screw holes 21 for connection to the screw elements 17 connected with the plate 13 nearest the disc 9, and recesses 22 for clearance of the screw elements 17 connected with the plate 11 nearest the body 8. Also in the grinding disc 9 are formed alternately screw holes 23 for connection with the screw elements 17 connected with the plate 11 nearest the carrier 8, and recesses 24 for clearance of the screw elements 17 connected to the plate 13 nearest the grinding disc 9. The term clearance in this context means that the recesses 22 and 24 are structured so that the screw element 17 projecting therein can be fully held without coming into contact with the respective recess 22, 24.

The screw elements 17 are preferably screws with a cylindrical screw head of the internal hexagon type, a circular cylindrical part 26 connected thereto which has a length adapted to the height h of the stack of plates 11–13, a threaded part 27 which has a smaller diameter than the circular cylindrical part 26, and a nut 28 which is screwed to the threaded part 27. It will be seen that a screw head of the internal hexagon type is a suitable choice as this is easy to screw in and out even as shown when countersunk into a screw hole 21, 23 with a stepped bore. It is also seen that a circular cylindrical part 26 with a precisely defined length can contribute to ensure even quality in connection with the mounting of the coupling element 10. Finally it is also seen that with a view to the vibrations occurring it is advisable for the nuts 28 to be selected of the self-locking type.

The arrangement according to the invention can where applicable be modified in any way within the context of the claims. Thus the form of the plates 11–13 can be different to that shown on the drawings, the number of drain holes 15 can be both greater and lesser, and the carrier 8 can for example be star-shaped.

The invention claimed is:

1. Grinding head for a mobile grinding machine for grinding stone floors, which grinding machine comprises a body carrying a drive motor, a planet disc mounted in the body and a multiplicity of grinding heads mounted on the planet disc, where the planet disc can be rotated by means of the motor about a substantially vertical rotational axis and the grinding heads can be rotated relative to the planet disc around substantially vertical planet axes which are distributed around the rotation axis, wherein the grinding head concerned comprises a carrier that is designed to be rotated by means of the motor and a grinding disc that is designed to be driven by the carrier by means of a coupling element established between the carrier and the grinding disc, which coupling element comprises a multiplicity of plates stacked on each other and each with a central opening and at least four drain holes distributed around this, and a compression spring which extends through the central opening of the plates and by means of screw elements is clamped between the carrier and the grinding disc, which screw elements extend through the drain holes of the plates and are arranged to connect alternately, in a circular direction around the central opening of the plates, the carrier with the plate nearest the grinding disc and the grinding disc with the plate nearest the carrier.

2. Grinding head according to claim 1, wherein the coupling element at the drain holes of the plates has spacer elements at least between the plates.

3. Grinding head according to claim 2, wherein the spacer elements comprise annular metal washers which have rounded outer edges.

4. Grinding head according to claim 1, wherein the compression spring is a substantially circular cylindrical block of elastomer material.

5. Grinding head according to claim 1, wherein the plates are annular and have projecting lugs in which are formed the drain holes.

6. Grinding head according to claim 5, wherein the contour of the plates between the said lugs has the shape of a curve curving in towards the central opening of the plates.

7. Grinding head according to claim 1, wherein the carrier is formed as a circular plate in which are formed alternately screw holes for connection with the screw elements connected with the plate nearest the grinding disc, and recesses for clearance of the screw elements connected with the plate nearest the carrier.

8. Grinding head according to claim 1, wherein in the grinding disc are formed alternately screw holes for connection with the screw elements connected with the plate nearest the carrier, and recesses for clearance of the screw elements connected with the plate nearest the grinding disc.

9. Grinding head according to claim 7, wherein the screw holes are countersunk.

10. Grinding head according to claim 1, wherein the screw elements are screws comprising a screw head, a circular cylindrical part connected thereto which has a length adapted to the height of the stack of plates, a threaded part which has a smaller diameter than the circular cylindrical part, and a nut which can be screwed to the threaded part.

11. Mobile grinding machine for grinding a stone floor, which grinding machine comprises a body carrying a drive motor, a planet disc mounted in the body, and a multiplicity of grinding heads mounted on the planet disc, where the planet disc is rotatable by means of the motor about a central, substantially vertical rotation axis and the grinding heads relative to the planet disc are rotatable about substantially vertical planet axes distributed around the said rotation axis, wherein it comprises the grinding head according to claim 1.

12. Coupling element for a mobile grinding machine for grinding a stone floor, for transferring a torque between the carrier and a grinding disc, wherein the coupling element comprises a multiplicity of plates which are stacked on each other and each have a central opening and at least four drain holes distributed around this, and a compression spring which extends through the central opening of the plates, and by means of the screw elements is clamped between the drive axle and the grinding disc, which screw elements extend through the drain holes of the plates and are arranged to connect alternately, in a circular direction around the central opening of the plates, the drive axle with the plate nearest the grinding disc and the grinding disc with the plate nearest the drive axle.

* * * * *